US007673694B2

(12) United States Patent
Wagner et al.

(10) Patent No.: US 7,673,694 B2
(45) Date of Patent: Mar. 9, 2010

(54) INERTIZATION DEVICE WITH NITROGEN GENERATOR

(75) Inventors: Ernst-Werner Wagner, Winsen/Aller (DE); Peter Clauss, Ratingen (DE)

(73) Assignee: Amrona AG, Zug (CH)

( * ) Notice: Subject to any disclaimer, the term of this patent is extended or adjusted under 35 U.S.C. 154(b) by 254 days.

(21) Appl. No.: 11/874,618

(22) Filed: Oct. 18, 2007

(65) Prior Publication Data

US 2008/0156506 A1 Jul. 3, 2008

(30) Foreign Application Priority Data

Oct. 19, 2006 (EP) ..... 06122593

(51) Int. Cl.
*A62C 35/00* (2006.01)

(52) U.S. Cl. ..... 169/11; 169/5; 169/16; 169/54; 169/56; 239/69

(58) Field of Classification Search ..... 169/5, 169/9, 11, 16, 54, 56, 61; 239/69
See application file for complete search history.

(56) References Cited

U.S. PATENT DOCUMENTS 2,990,886 A * 7/1961 Dean ..... 169/9
4,616,694 A * 10/1986 Hsieh ..... 169/61
6,739,399 B2 * 5/2004 Wagner et al. ..... 169/54
7,594,545 B2 * 9/2009 Love ..... 169/11

FOREIGN PATENT DOCUMENTS

DE 198 11 851 C2 1/2001
DE 102 49 126 A1 6/2004
EP 1 683 548 A 7/2006

* cited by examiner

*Primary Examiner*—Steven J Ganey
(74) *Attorney, Agent, or Firm*—Fraser Clemens Martin & Miller LLC; James D. Miller

(57) ABSTRACT

The invention relates to an inertization device for establishing and maintaining an inertization level in a protective room. The inertization device has a controllable inert gas system for providing inert gas, a first supply pipe system connected to the inert gas system and the protective room to supply the inert gas to the protective room, and a control unit to control the inert gas system such that a presettable inertization level is established and maintained inside the protective room. In order to raise the inertization level inside the protective room rapidly to an accessibility level without requiring major structural measures, a valve controlled by the control unit is connected to the inert gas system and the first supply pipe system to supply the exhaust air prepared by the inert gas system as fresh air to the protective room.

19 Claims, 5 Drawing Sheets

INERTIZATION DEVICE WITH NITROGEN GENERATOR

CROSS REFERENCE TO RELATED APPLICATION

This application claims the benefit of European Application 06122593.4 filed on Oct. 19, 2006, the disclosure of which is hereby incorporated herein by reference, in its entirety.

FIELD OF THE INVENTION

The present invention relates to an inertization device for establishing and maintaining a presettable inertization level in a monitored protective room, whereby the inertization device has a controllable inert gas system for providing an inert gas, a first supply pipe system that is connected to the inert gas system and which can be connected to the protective room in order to supply the inert gas provided by the inert gas system to the protective room, and a control device, which is configured to control the inert gas system in such a way that a specific, presettable inertization level is established and maintained inside the protective room.

BACKGROUND OF THE INVENTION

Such an inertization device is known in principle from the prior art. For example, German Patent Specification DE 198 11 851 C2 describes an inertization device for reducing the risk of fire and for extinguishing fires in enclosed spaces. The known system is configured to decrease the oxygen concentration within an enclosed room (hereinafter called "protective room") to a base inertization level, which can be preset in advance, and in the event of a fire to rapidly further decrease the oxygen concentration to a specific full inertization level, thereby enabling the fire to be effectively extinguished with the smallest possible storage capacity required for inert gas tanks. For this purpose, the known device has an inert gas system that can be controlled via a control unit, and a supply pipe system that is connected to the inert gas system and to the protective room, via which the inert gas provided by the inert gas system is supplied to the protective room. The inert gas system can be either a steel cylinder battery, in which the inert gas is stored in compressed form, a system for generating inert gases, or a combination of these two options.

The inertization device of the type initially mentioned is a system for reducing the risk of fire and for extinguishing fires in the monitored protective room, whereby a sustained inertization of the protective room is used to prevent and/or to fight fires. The functioning method of the inertization device is based upon the knowledge, that in enclosed spaces, the risk of fire can be countered by reducing the oxygen concentration in the relevant area in a sustained manner to a level of, for example, approximately 12 vol.-% under normal conditions. At this oxygen concentration, most combustible materials can no longer burn. The main areas of application include especially ADP areas, electrical switching and distribution spaces, enclosed facilities, and storage areas containing high-value commercial goods.

The prevention and/or extinguishing effect that results from the inertization process is based upon the principle of oxygen displacement. As is known, normal environmental air is made up of 21 vol.-% oxygen, 78 vol.-% nitrogen and 1 vol.-% other gases. In order to effectively decrease the risk that a fire will start in a protective room, the oxygen concentration is decreased in the relevant space by introducing inert gas, such as nitrogen. With respect to extinguishing fire in most solid materials, it is known, for example, that an extinguishing effect is generated when the oxygen ratio drops below 15 vol.-%. Depending upon the combustible materials that are present in the protective room, a further decrease in the oxygen ratio, for example to 12 vol.-%, may be necessary. In other words, with a sustained inertization of the protective room to a so-called "base inertization level," at which the oxygen ratio in the air inside the room is decreased, for example to below 15 vol.-%, the risk of a fire igniting inside the protective room can be effectively decreased.

The term "base inertization level" used herein is generally understood to refer to an oxygen concentration in the air inside the protective room that is reduced as compared with the oxygen concentration of normal environmental air, whereby, however, in principle this reduced oxygen concentration presents no danger of any kind to persons or animals from a medical standpoint, so that they are still able to enter the protective room—under certain circumstances, with certain protective measures. As was already mentioned, the establishment of a base inertization level which, in contrast to the so-called "full-inertization level", need not correspond to an oxygen ratio that is decreased such that fire is effectively extinguished, serves primarily to reduce the risk of a fire igniting within the protective room. The base inertization level corresponds to an oxygen concentration of, for example, 13 vol.-% to 15 vol.-% —depending upon the circumstances of the individual case.

In contrast, the term "full inertization level" refers to an oxygen concentration that is further reduced as compared with the oxygen concentration of the base inertization level, and at which the flammability of most materials is already decreased so far, that they are no longer capable of igniting. Depending upon the fire load present inside the protective room, the full inertization level generally ranges from 11 vol.-% to 12 vol.-% oxygen concentration.

Although, in principle, the reduced oxygen concentration which corresponds to the base inertization level in the air inside the protective room presents no danger to persons and animals, so that they can safely enter the protective room, at least for short periods of time, without significant hardships, for example without gas masks, certain nationally stipulated safety measures must be adhered to in entering a room that has been permanently inertized to a base inertization level, because, in principle, a stay in a reduced oxygen atmosphere can lead to an oxygen deficiency, which under certain circumstances can have physiological consequences in the human organism. These safety measures are stipulated in the respective national regulations, and are dependent especially upon the level of reduced oxygen concentration that corresponds to the base inertization level.

In Table 1 below, these effects on the human organism and on the combustibility of materials are presented.

In order to adhere to the safety measures with regard to the passability of the protected room stipulated in the national regulations, which become stricter as the oxygen ratio in the air inside the protective room decreases in a simple manner that is especially easy to implement, it would be conceivable for the purpose of and for the duration of passage into the room to raise the sustained inertization of the protective room from the base inertization level to a so-called passability level, at which the prescribed safety requirements are lower and can be met without major inconvenience.

TABLE 1

| Oxygen ratio inside the protective room | Effect on the human organism | Effect on the combustibility of materials |
|---|---|---|
| 8 vol.-% | Risk to life | Not combustible |
| 10 vol.-% | Discernment and sensitivity to pain diminish | Not combustible |
| 12 vol.-% | Fatigue, elevation of respiratory volume and pulse | Difficult to ignite |
| 15 vol.-% | None | Difficult to ignite |
| 21 vol.-% | None | None |

For example, in a protective room that under normal conditions is permanently inertized to a base inertization level of, for example, 13.8 to 14.5 vol.-%, at which, according to Table 1, an effective suppression of fire can be achieved, it would make sense to reduce the oxygen ratio to a passability level, for example of 15 to 17 vol.-%, when it is to be entered, for example for maintenance purposes.

From a medical point of view, a temporary stay in an oxygen atmosphere that has been reduced to this passability level is safe for persons who have no cardiac, circulatory, vascular or respiratory illnesses, so that the respective national regulations governing this require no, or only minor, additional safety measures.

Ordinarily, raising the inertization level established inside the protective room from the base inertization level to the passability level is accomplished via a corresponding control of the inert gas system. In that regard it is practical, especially for economic reasons, to consistently maintain the inertization level established inside the protective room at the passability level during passage into the protective room (for instance with a corresponding control range), in order to minimize the quantity of inert gas to be introduced back into the protective room once the visit has been completed, in order to reestablish the base inertization level. For this reason, the inert gas system should also be generating and/or providing inert gas during the period of passage into the protective room, so that the inert gas will be correspondingly supplied to the protective room, in order to maintain the inertization level there at the passability level (optionally with a specific control range).

In the process n it is noted, that the term "passability level" used herein refers to an oxygen concentration in the air inside the protective room which is reduced in comparison with the oxygen concentration of the normal surrounding air, in which the respective national regulations require no, or only minor, supplementary safety measures for entering the protective room. As a rule, the passability level corresponds to an oxygen ratio in the air inside the room that is higher than a base inertization level.

SUMMARY OF THE INVENTION

The object of the present invention is now to further improve upon an inertization device of the type initially mentioned such that it can be reliably ensured, that the inertization level in a permanently inertized protective room can be rapidly raised to a passability level, without major additional structural measures being required.

Expressed in general terms, the object of the present invention is to propose an inertization device of the aforementioned type with which an inertization level that can be preset in a protective room which is to be monitored can be reliably established and/or maintained, whereby the inertization level established inside the protective room can be shifted as rapidly as possible between a base or a full inertization level and a passability level, with no major structural measures being required.

These objectives are attained with an inertization device of the type mentioned initially, in accordance with a first aspect of the invention, in that the inert gas system also has a bypass pipe system that can preferably be connected through to the control unit via a shut-off valve, and is connected both to a compressed air source and to the first supply pipe system, in order to supply as needed the compressed air provided by the compressed air source to the protective room as fresh air, thereby adjusting the oxygen concentration in the protective room to a level that corresponds to the specific inertization level to be established and/or maintained inside the protective room.

The advantages that can be achieved with the solution of the invention according to the first aspect are obvious: The quantity of inert gas supplied to the protective room and the oxygen concentration in the inert gas already in the inert gas system are regulated at the level required to establish and/or maintain the inertization level that can be preset inside the protective room, whereby the inert gas system is comprised of the inert gas system, the bypass pipe system that can be connected through to the control unit via a shut-off valve, and is connected both to a compressed air source and to the first supply pipe system, and the supply pipe system. Additionally, with the solution of the invention according to the first aspect, the inert gas system fulfills the function of providing both (ideally pure) inert gas and fresh air, so that the supply pipe system, which connects the inert gas system to the protective room, is used for the supply of pure inert gas, pure fresh air, or a mixture of the two.

In this connection it is noted that the term "compressed air" refers to compressed air in the broadest sense. Especially, however, the term "compressed air" is also intended to refer to both compressed air and oxygen-enriched air. The compressed air can be stored either in suitable pressurized tanks or generated on-site using suitable compressor systems.

In this connection it is further noted that the term "compressed air" also refers, for example, to fresh air, which is introduced into the bypass pipe system by means of a suitable blower. Because the air introduced into the bypass pipe system via a suitable blower is also under higher pressure as compared with normal environmental air, it is compressed air.

Specifically, with the solution of the invention the quantity of inert gas provided by the inert gas system and to be supplied to the protective room and/or the oxygen concentration in the inert gas is controlled via a corresponding control of the inert gas system, with which the absolute quantity of inert gas provided per unit of time, and is also controlled via a corresponding control of the shut-off valve allocated to the bypass pipe system, whereby the absolute quantity of fresh air supplied to the protective room per unit of time is adjusted.

In a particularly preferred further development of the solution of the invention according to the first aspect, it is provided, that the compressed air source has a pressurized storage tank for storing oxygen, oxygen-enriched air or compressed air, whereby the control unit is configured to control a controllable pressure-reducing valve that is allocated to the pressurized storage tank and is connected to the first supply pipe system, so as to establish and/or to maintain a certain inertization level inside the protective room. In this connection it is noted that, with this preferred implementation, the pressurized storage tank can be provided either as the compressed air source itself or as a separate, auxiliary unit in addition to the inertization device. The pressurized storage tank is advantageously in a fluid communication with the bypass pipe system connected via the shut-off valve.

In a particularly preferred implementation of the solution of the invention according to the first aspect and according to the embodiment of that described above, it is provided, that the inert gas system has a nitrogen generator which is connected to the compressed air source, in order to separate oxygen from the compressed air supplied from the compressed air source and to provide nitrogen-enriched air at a first outlet of the nitrogen generator, whereby the air provided by the nitrogen generator and enriched with nitrogen can be supplied as inert gas to the first supply pipe system via the first outlet of the nitrogen generator. It is thereby provided that the bypass pipe system bypasses the nitrogen generator, in order to direct the compressed air provided by the compressed air source, at least in part directly, as a fresh air supply to the protective room, as needed, and with a corresponding control of the shut-off valve which is allocated to the bypass pipe system, and in order to thereby adjust and/or maintain a certain inertization level inside the protective room. The nitrogen generator provided in the inert gas system can serve as the sole source of inert gas provided in the inertization device; it would also be conceivable, however, for the nitrogen generator, along with other pressurized inert gas storage tanks provided, which can be filled, for example, externally and/or via the nitrogen generator, to form the inert gas source of the inertization device. The nitrogen generator can especially be a generator based upon membrane technology or on PSA technology.

The use of nitrogen generators in inertization devices is already known. The nitrogen generator is a system with which air that is enriched with nitrogen can be generated, for example, from the normal environmental air. Such systems involve a gas separation system, whose function is based, for example, on gas separation membranes. In this, the nitrogen generator is designed to remove oxygen from the surrounding air. To construct an operational gas separation system based upon a nitrogen generator, a compressed air network or at least one compressor is required, which produces the preset capacity for the nitrogen generator. The functioning principle of the nitrogen generator is based upon the fact, that in the membrane system provided in the nitrogen generator, the various components contained in the compressed air supplied to the nitrogen generator (oxygen, nitrogen, noble gases, etc.) diffuse through the hollow fiber membranes at different rates based upon their molecular structures. Nitrogen, which has a low diffusion rate, penetrates the hollow fiber membranes very slowly, and therefore becomes enriched as it flows through the hollow fibers.

The objective upon which the present invention is based is further attained according to a second aspect of the invention with an inertization device of the type initially described, in which the inert gas system has a nitrogen generator that is connected to a compressed air source, in order to separate oxygen from the compressed air supplied via the compressed air source, and to provide nitrogen-enriched air at a first output of the nitrogen generator, whereby the air provided by the nitrogen generator and enriched with nitrogen can be supplied as an inert gas to the first supply pipe system via the first output of the nitrogen generator. According to the invention, with this second aspect of the invention it is now provided, that the nitrogen generator can be controlled via the control unit such that a certain inertization level can be established and/or maintained inside the protective room, whereby the oxygen concentration in the inert gas supplied to the protective room can be adjusted, in that the degree of nitrogen enrichment in the nitrogen-enriched air provided by the nitrogen generator is controlled based upon the residence time of the compressed air provided by the compressed air source in the air separation system of the nitrogen generator.

If, for example, membrane technology is used in the nitrogen generator, the general knowledge that different gases diffuse through materials at different rates is utilized. In this case, in the nitrogen generator the different diffusion rates of the main constituents of air, namely nitrogen, oxygen and water vapor, are technically used to generate a nitrogen flow and/or air that are enriched with nitrogen. Specifically, for the technical implementation of a nitrogen generator based upon membrane technology, a separation material is applied to the outer surfaces of hollow fiber membranes, through which material water vapor and oxygen diffuse very readily. The nitrogen, in contrast, has only a low diffusion rate for this separation material. When air flows through the interior of the hollow fiber prepared in this manner, water vapor and oxygen diffuse rapidly toward the outside through the hollow fiber wall, while the nitrogen is largely held within the fibers, so that during the passage through the hollow fibers a heavy concentration of the nitrogen occurs. The effectiveness of this separation process is essentially dependent upon the flow rate in the fibers and the pressure difference beyond the hollow fiber wall. With a decreasing flow rate and/or higher pressure differential between the inside and outside of the hollow fiber membrane, the purity of the resulting nitrogen flow increases. Expressed in general terms, therefore, with a nitrogen generator based upon membrane technology, the degree of nitrogen enrichment in the nitrogen-enriched air provided by the nitrogen generator can be controlled based upon the residence time of the compressed air provided by the compressed air source in the air separation system of the nitrogen generator.

If, on the other hand, PSA technology is, for example, used in the nitrogen generator, the different bonding rates of atmospheric oxygen and atmospheric nitrogen to specially treated activated carbon are utilized. In the process the structure of the activated carbon that is used is altered to produce an extremely large surface with a large number of micropores and sub-micropores ($d<1$ nm). At this pore size, the oxygen molecules in the air diffuse significantly faster than the nitrogen molecules into the pores, so that the air in the area surrounding the activated carbon becomes enriched with nitrogen. Therefore, with a nitrogen generator based upon PSA technology—as with a generator based upon membrane technology—the degree of nitrogen enrichment in the nitrogen-enriched air that is provided by the nitrogen generator can be controlled based upon the residence time of the compressed air prepared by the compressed air source in the nitrogen generator.

An expert will recognize that the solution according to the second aspect of the invention, in broadest terms, involves a special embodiment of the previously discussed inertization device according to the first aspect, so that the advantages already discussed in connection with the first aspect can also be achieved with the second aspect. It is noted that with the implementation according to the second aspect as well, the quantity of inert gas provided by the inert gas system and to be supplied to the protective room and/or the oxygen concentration in the inert gas from the inert gas system itself is/are controlled at the corresponding level, whereby, however, in this case the knowledge is also utilized, that, when a nitrogen generator is used as the inert gas system, the adjusted level of purity of the gas flow provided by the nitrogen generator and enriched with nitrogen is dependent, for example, upon the rate at which the compressed air flows through the membrane system or the PSA system of the nitrogen generator, for example, and therefore upon the residence time of the compressed air in the air separation system of the nitrogen generator.

In one possible implementation of the latter embodiment, in which a certain inertization level is established or maintained inside the protective room for the duration of the residence time in the nitrogen generator of the compressed air provided by the compressed air source, it is provided that the air separation system (membrane system or PSA system) contained in the nitrogen generator has a cascade of multiple individual air separation units, whereby the number of individual air separation units that are used to separate oxygen from the compressed air supplied via the compressed air source and to prepare the air which is enriched with nitrogen can be selected via the control unit, at the first outlet of the nitrogen generator, whereby the degree of nitrogen enrichment in the nitrogen-enriched air prepared by the nitrogen generator is controlled based upon the number of individual air separation units selected via the control unit. The selection of the number of individual air separation units initiated by the control unit can, for example, be implemented using a correspondingly configured bypass pipe system that is connected to the respective intakes and outlets of the individual air separation units. Accordingly, with this preferred embodiment of the second aspect of the invention, the oxygen concentration in the inert gas that is supplied to the protective room—as with the embodiment according to the first aspect of the invention—is adjusted via the provision of a correspondingly configured bypass pipe system. Of course, other embodiments for selecting the number of individual air separation units are also possible.

In a further embodiment of the latter implementations of the second aspect of the inertization device of the invention, in which the oxygen concentration in the inert gas supplied to the protective room is controlled based upon the residence time of the compressed air in the air separation system, it is provided that the compressed air source which is connected to the nitrogen generator can be controlled by the control unit so as to control the rate at which the compressed air flows through the air separation system contained in the nitrogen generator, thereby controlling the dwell time of the compressed air in the air separation system.

According to a further (third) aspect of the present invention, the objective upon which the invention is based is attained with an inertization device of the type described at the beginning, in which the inert gas system also has a nitrogen generator connected to a compressed air source, with an air separation system contained therein, in order to separate oxygen from the compressed air supplied via the compressed air source, and to make nitrogen-enriched air available at a first outlet of the nitrogen generator, whereby the nitrogen-enriched air provided by the nitrogen generator can be supplied as inert gas to the first supply pipe system via the first outlet of the nitrogen generator. According to the invention, it is envisioned that the inertization device further has a second supply pipe system that can be connected to the inert gas system, whereby the oxygen which is removed from the compressed air by the nitrogen generator can be supplied as oxygen-enriched air to the second supply pipe system via a second outlet of the nitrogen generator, in order to thereby establish and/or maintain a specific inertization level inside the protective room.

Thus, according to this third aspect of the invention, the exhaust air from the nitrogen generator, which consists essentially of oxygen-enriched air and is usually vented into the surrounding air, is used to adjust the oxygen concentration inside the protective room using this exhaust air.

The additional advantages to be achieved with the third aspect of the present invention are obvious. According to these, for example, the raising of a full or base inertization level established inside the protective room to an accessibility level can be implemented within the shortest possible time with an inertization device according to the third aspect of the invention.

At this point it should be noted, that the individual characterizing features according to the first, second and third aspects of the present invention can, of course, be combined with one another. In other words, this means that, for example, an inertization device according to the first aspect is also conceivable in which the inert gas system also has a nitrogen generator, whereby the oxygen-enriched air generated as exhaust air from the nitrogen generator can be used to adjust the oxygen concentration inside the protective room. On the other hand, however, other combinations of the characterizing features of the individual aspects of the invention are also conceivable.

Especially with the third aspect of the present invention, it is preferably further provided that the second supply pipe system empties into the first supply pipe system, and can therefore be connected to the protective room via the first supply pipe system, so that again this first supply pipe system is used solely by itself to establish and/or maintain a certain inertization level inside the protective room.

In order to be able to establish the preset, sustained inertization level inside the protective room as rapidly as possible, and to maintain it precisely, with the inertization device according to the third aspect, it is preferably provided that the inertization device according to the third aspect further has a shut-off valve which is allocated to the second supply pipe system and can be controlled via the control unit, for breaking the connection that can be produced between the second outlet of the nitrogen generator and the protective room by means of the second supply pipe system. Such a controllable shut-off valve would be, for example, an appropriately adjustable control valve or a similar valve.

With a preferred further improvement on the inertization device according to the third aspect, the inertization system further has a pressurized storage tank for storing the air provided by the nitrogen generator and enriched with oxygen, whereby the control unit is configured so as to control a controllable pressure-reducing valve that is associated with this so-called "pressurized oxygen storage tank" and is connected to the second supply pipe system, in order to establish and/or maintain a certain inertization level inside the protective room.

In one preferred implementation of the latter embodiment of the inertization device according to the third aspect of the invention, a pressure-dependent valve device is further provided, which is opened in a first pressure range that can be preset, permitting the pressurized oxygen storage tank to be filled with the oxygen-enriched air provided by the nitrogen generator.

Below, preferred further improvements will be described, which can be used in the inertization device according to one of the aforementioned and described aspects.

For instance, it would be conceivable, for example, for the inertization device to also have at least one shut-off valve that is allocated to the first supply pipe system and can be controlled via the control unit, for breaking the connection which can be produced between the first output of the nitrogen generator and the protective room via the first supply pipe system. With this controllable shut-off valve that can be allocated to the first supply pipe system, the nitrogen supply can thereby be controlled. This is a particular advantage in terms of maintaining a presettable inertization level inside the protective room, because in this case the quantity of inert gas to be supplied to the protective room and/or the oxygen concentration of the inert gas is primarily dependent solely upon the air exchange rate inside the protective room, and can assume a correspondingly low level depending upon the configuration of the protective room.

In one advantageous further development of the inertization device according to the aforementioned aspects, although this is in part known from the prior art, at least one oxygen detection device for detecting the oxygen ratio in the air inside the protective room is further provided, whereby the control unit is configured to adjust the quantity of inert gas to be supplied to the protective room and/or the oxygen concentration of the inert gas, based upon the oxygen ratio measured in the air inside the protective room, in order to thereby supply, in principle, only that quantity of inert gas to the protective room which is actually required to establish and/or to maintain a certain inertization level inside the protective room. The provision of an oxygen detection device of this type, in particular ensures, that the inertization level to be established inside the protective room can be established and/or maintained as precisely as possible by supplying a suitable quantity of inert gas and/or a suitable quantity of fresh air and/or oxygen. It would thereby be conceivable for the oxygen detection device to emit a corresponding signal to the corresponding control unit, continuously or at preset time intervals, as a result of which the inert gas system is correspondingly controlled, in order always to supply the quantity of inert gas to the protective room that is necessary to maintain the inertization level established inside the protective room.

At this point it is noted that an expert will recognize that the term "maintaining the oxygen concentration at a certain inertization level" which is used herein refers to maintaining the oxygen concentration at the inertization level with a certain control range, whereby the control range can preferably be selected based upon the type of protective room (for example based upon an air exchange rate that is valid for the protective room, or based upon the materials stored inside the protective room), and/or based upon the type of inertization system used. Typically, a control range of this type is around ±0.2 vol.-%. Of course, however, other control ranges are also conceivable.

In addition to the aforementioned continuous and/or regular measurement of the oxygen concentration, however, the oxygen concentration can be maintained at the specific preset inertization level based upon a previously performed calculation, whereby in this calculation certain design parameters of the protective room should be included, such as the air exchange rate that is valid for the protective room, for example, especially the n50 value of the protective room, and/or the pressure difference between the protective room and the surrounding area.

As the oxygen detection device, an aspiration-type device is especially well-suited. With this type of device, representative air samples are continually taken from the air inside the monitored protective room and are fed to an oxygen detector, which emits a corresponding detection signal to the appropriate control unit.

In principle, it is conceivable to provide an environmental air compressor and an inert gas generator connected thereto as the inert gas system, whereby the control unit is configured, for example, to control the air flow rate of the environmental air compressor such that the quantity of inert gas to be supplied to the protective room, prepared by the inert gas system, and/or the oxygen concentration in the inert gas are set at the level which is appropriate for establishing and/or maintaining the first presettable inertization level. This solution, which is preferred in terms of the inert gas system, is characterized especially in that the inert gas system is capable of generating the inert gas on-site, whereby the necessity, for example, of providing a pressurized tank battery in which the inert gas is stored in compressed form is eliminated.

However it would, of course, also be conceivable for the inert gas system to have a pressurized inert gas storage tank, whereby the control unit would be configured so as to control a controllable pressure-reducing valve which is associated with the inert gas pressurized storage tank and is connected to the first supply pipe system, so as to set the quantity of inert gas, provided by the inert gas system, to be supplied to the protective room and/or the oxygen concentration in the inert gas at the level which is appropriate for establishing and/or maintaining the presettable inertization level. The pressurized inert gas storage tank can be provided in combination with the aforementioned environmental air compressor and/or inert gas generator, or alone.

In a preferred further improvement of the latter embodiment, in which the inert gas system has a so-called "pressurized inert gas storage tank", it is envisioned that the inertization device also has a pressure-dependent valve unit which is opened in a first presettable pressure range, for example between 1 and 4 bar, and permits filling of the inert gas pressurized storage container via the inert gas system.

As was already indicated, the solution of the invention is not restricted to the establishment and/or maintenance of the passability level inside the protective room. Rather, the claimed inertization device is configured such that the presettable inertization level can be a full inertization level, a base inertization level, or an accessibility level.

BRIEF DESCRIPTION OF THE DRAWINGS

Below preferred embodiments of the inertization device according to the invention will be described in greater detail with reference to the set of drawings.

The drawings show.

DETAILED DESCRIPTION OF THE PREFERRED EMBODIMENT

Figure 1:
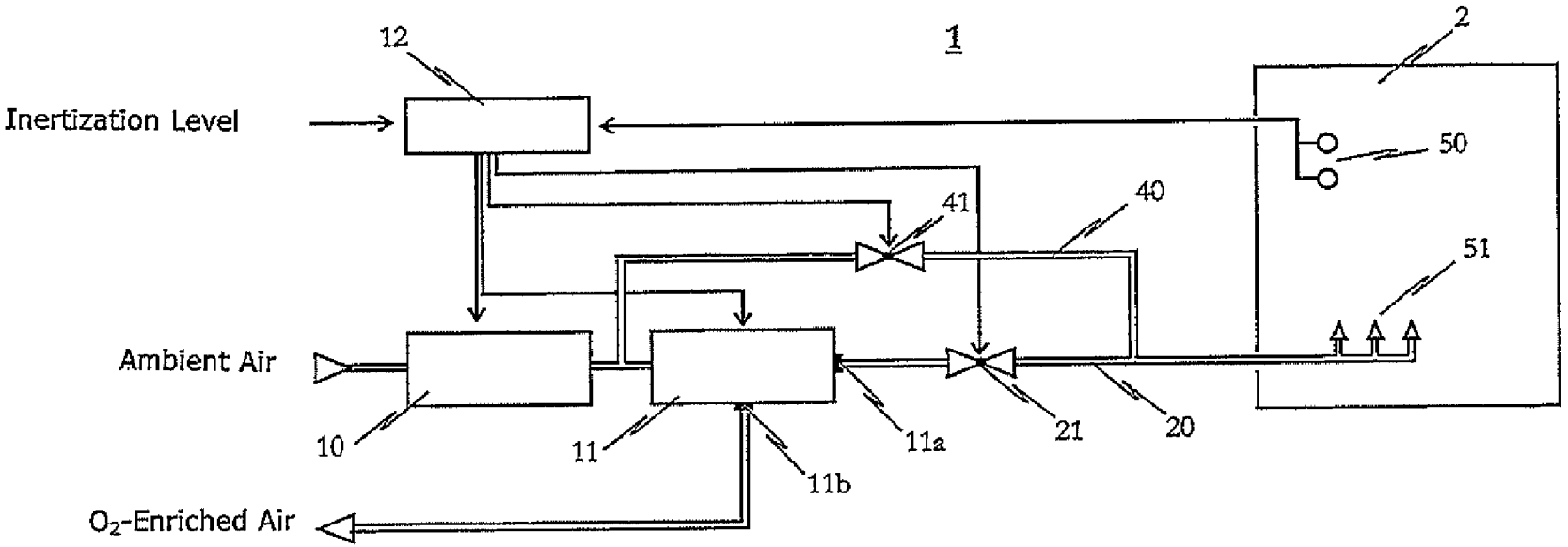
FIG. 1 illustrates a schematic view of a first embodiment of the inertization device of the invention according to a combination of the first and second aspects of the invention.

Shown in FIG. 1 is a first embodiment of the inertization device 1 of the invention for establishing and maintaining an inertization level that can be preset inside a protective room 2 to be monitored, according to a combination of the first and second aspects of the invention. Essentially, the inertization device 1 is comprised of an inert gas system, which in the depicted embodiment has an environmental air compressor 10 and an inert gas and/or nitrogen generator 11 connected to the former. A control unit 12 is also provided, which is configured to switch the environmental air compressor 10 and/or the nitrogen generator 11 on and off via corresponding control signals. In this manner, a preset inertization level can be established and maintained inside the protective room 2 via the control unit 12.

The inert gas generated by the inert gas system 10, 11 is supplied to the protective room 2 to be monitored via a supply pipe system 20 ("first supply pipe system"); of course, multiple protective rooms may also be connected to the supply pipe system 20. Specifically, the inert gas provided by the inert gas system 10, 11 is supplied via corresponding discharge nozzles 51, which are arranged at a suitable point inside the protective room 2.

In the embodiment of the solution of the invention shown in FIG. 1, the inert gas, advantageously nitrogen, is obtained on-site from the surrounding air. The inert gas generator and/or nitrogen generator 11 functions, for example, on the basis of membrane or PSA technology, known from the state of technology, to generate nitrogen-enriched air having a nitrogen ratio of, for example, 90 vol.-% to 95 vol.-%. This nitrogen-enriched air serves as inert gas in the embodiment shown in FIG. 1, which is supplied to the protective room 2 via the supply pipe system 20. The air that is enriched with oxygen and reaches the outlet 11*b* as exhaust air during generation of the inert gas in this case is vented via a second pipe system to the outside.

Specifically, it is provided, that the control unit 12 controls the inert gas system 10, 11, based upon an inertization signal, for example, input by the user into the control unit 12, such that the preset inertization level inside the protective room 2 is established and maintained. The desired inertization level can be selected on the control unit 12, for example, using a key switch or on a password protected, control panel (not explicitly shown here). Of course, it is also conceivable for the inertization level to be selected according to a predetermined sequence of events.

For example, if the base inertization level, which has been determined in advance, is selected on the control unit 12, taking into account in particular the characteristic values of the protective room 2, and, if in the selection of the base inertization level inside the protective room 2, no inertization level has yet been established, i.e. if a gas atmosphere is present inside the protective room that is essentially identical to the chemical composition of the surrounding air, a shut-off valve 21 which is allocated to the supply pipe system 20 is switched via the control unit 12 to the direct supply of the inert gas provided by the inert gas system 10, 11 into the protective room 2. At the same time, using an oxygen detection device 50, the oxygen concentration inside the protective room 2 is preferably continuously measured. As shown, the oxygen detection device 50 is connected to the control unit 12, so that the control unit 12 in principle has knowledge of the oxygen concentration established inside the protective room 2.

If it is determined by measuring the oxygen concentration inside the protective room 2 that the base inertization level inside the protective room 2 has been reached, the control unit 12 emits a corresponding signal to the inert gas system 10, 11 and/or to the shut-off valve 21 to shut off the further supply of inert gas. Over the course of time, inert gas escapes through certain leakage points, so that the oxygen concentration in the atmosphere inside the room increases. When the inertization level has changed a certain amount from the target level, the control unit 12 emits a corresponding signal to the inert gas system 10, 11 and/or to the shut-off valve 21 to switch the supply of inert gas back on.

According to the embodiment shown in FIG. 1, a bypass pipe system 40 is further provided which connects the outlet of the compressed air source 10 to the supply pipe system 20. Over this bypass pipe system 40, the compressed air provided by the compressed air source 10 can be supplied as needed as fresh air directly to the supply pipe system 20 and thereby to the protective room 2. A direct fresh air supply into the protective room 2 is necessary, when the inertization level established in the protective room 2 corresponds to an oxygen concentration that is lower than the oxygen concentration of an inertization level to be established inside the protective room 2. This would be the case, for example, if, during establishment of the base inertization level inside the protective room 2, too much inert gas is introduced inadvertently or for other reasons. On the other hand, a supply of fresh air is also necessary, when a sustained inertization which has already been established inside the protective room 2 must be raised as rapidly as possible, as is necessary, for example, to allow passage into the protective room 2.

Expressed in general terms, with the inert gas system according to the first embodiment of the inertization device 1 of the invention, as represented in FIG. 1, the quantity of inert gas to be supplied to the protective room to establish and/or maintain a specific inertization level, and/or the oxygen concentration in the inert gas is provided, whereby this inert gas prepared by the inert gas system is supplied to the protective room 2 via one and the same supply pipe system 20.

Figure 2:
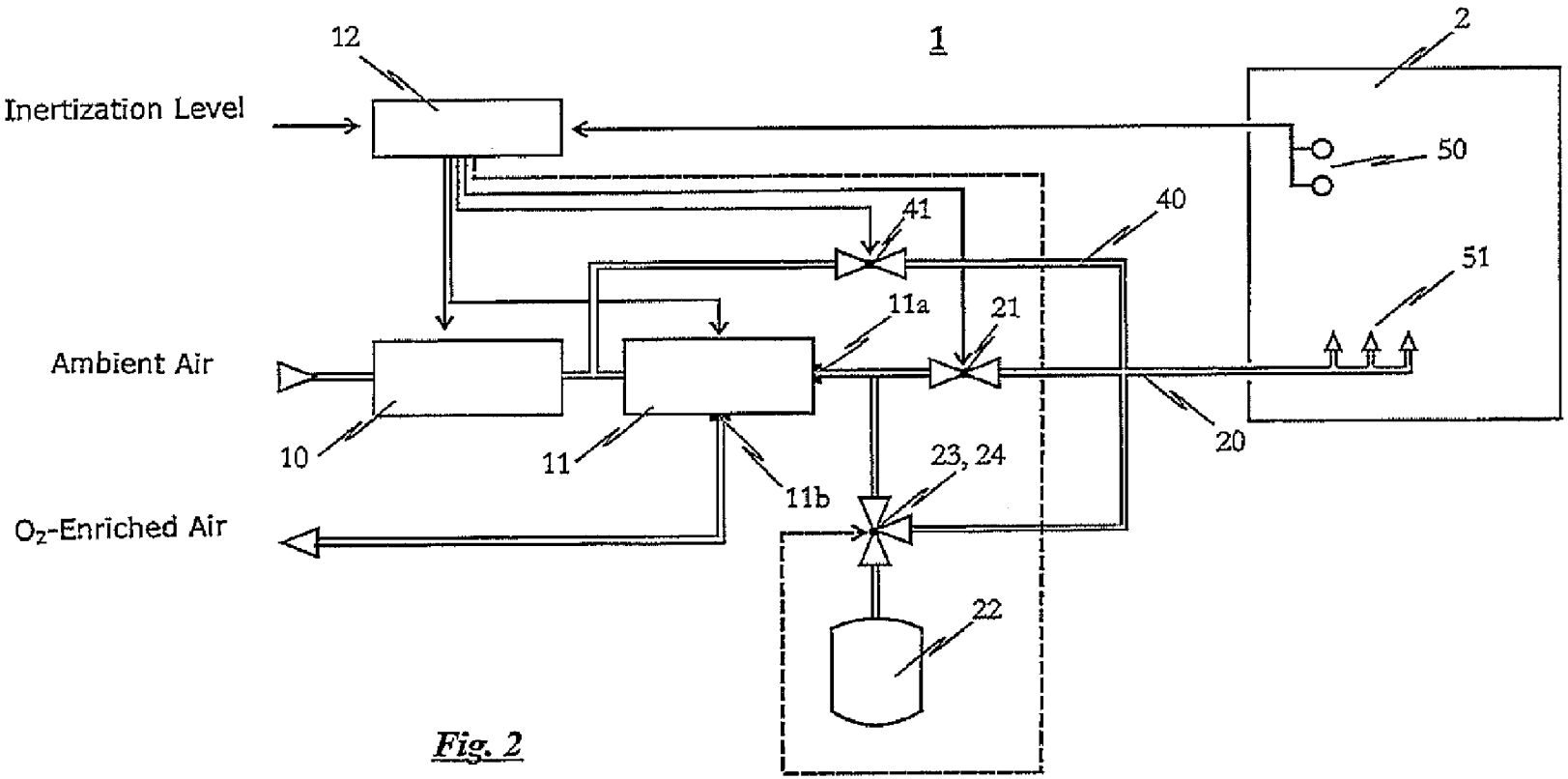
FIG. 2 illustrates a schematic view of a second embodiment of the inertization device of the invention according to the combination shown in FIG. 1 of the first and second aspects of the invention.

FIG. 2 shows a schematic view of a second embodiment of the inertization device 1 according to the combination of the first and second aspects of the invention, shown in FIG. 1. In contrast to the embodiment represented in FIG. 1, the inertization device 1 shown in FIG. 2 also has a pressurized storage tank 22 for storing the air that in this case is prepared by the nitrogen generator 11 and enriched with nitrogen. It is further indicated in FIG. 2 that the control unit 12 is configured to control a pressure-reducing valve which is allocated to the pressurized nitrogen storage tank 22 and is connected to the first supply pipe system 20, such that ultimately the prepared quantity of the inert gas to be supplied to the protective room 2 and/or the oxygen concentration in the inert gas can be set at the level that is appropriate for establishing and/or maintaining the specific inertization level.

Furthermore, in the embodiment according to FIG. 2, a pressure-dependent valve unit 24 is provided which is opened in a first presettable pressure range, thereby permitting the pressurized nitrogen storage tank 22 to be filled with the nitrogen-enriched air that has been prepared by the nitrogen generator 11.

Figure 3:
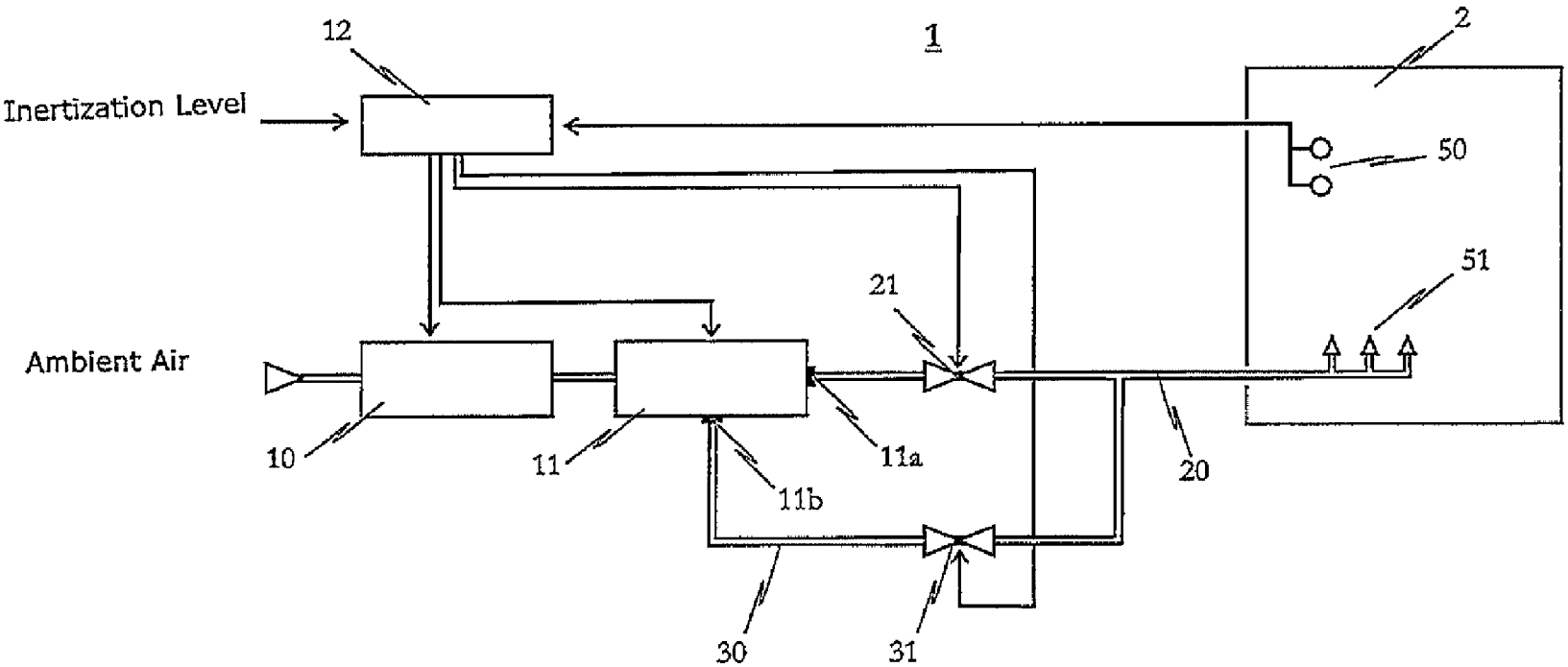
FIG. 3 illustrates a schematic view of a first embodiment of the inertization device of the invention according to the third aspect of the present invention.

FIG. 3 shows a schematic view of a first embodiment of the inertization device 1 of the invention according to the third aspect of the invention.

It is hereby provided, that the inert gas system 10, 11 has a nitrogen generator 11 connected to the compressed air source 10, with an air separation system contained therein (not explicitly shown) for separating oxygen from the compressed air supplied via the compressed air source 10 and for providing nitrogen-enriched air at a first outlet 11*a* of the nitrogen generator 11. Specifically it is provided that the nitrogen-enriched air provided by the nitrogen generator 11 can be supplied as inert gas to the first supply pipe system 20 via the first outlet 11*a* of the nitrogen generator.

In contrast to the embodiments of the solution of the invention described in reference to FIG. 1 and FIG. 2, in the system according to FIG. 3 it is envisioned that the inertization device 11 further has a second supply pipe system 30 which is connected to the inert gas system 10, 11, and can be connected to the protective room 2 via a shut-off valve 31 that can be controlled via the control unit 12, whereby the oxygen separated out of the compressed air by the nitrogen generator 11 can be supplied to the second supply pipe system 30 as oxygen-enriched air via a second outlet 11*b* of the nitrogen generator 11. In this, the second supply pipe system 30 empties into the first supply pipe system 20 and can accordingly be connected to the protective room 2 via the first supply pipe system 20. With a suitable control of the inert gas system 10, 11, the shut-off valve 21 allocated to the first supply pipe system 20, and/or the shut-off valve 31 allocated to the second supply pipe system 30, it is therefore possible to rapidly establish and precisely maintain a specific inertization level inside the protective room 2.

Figure 4:
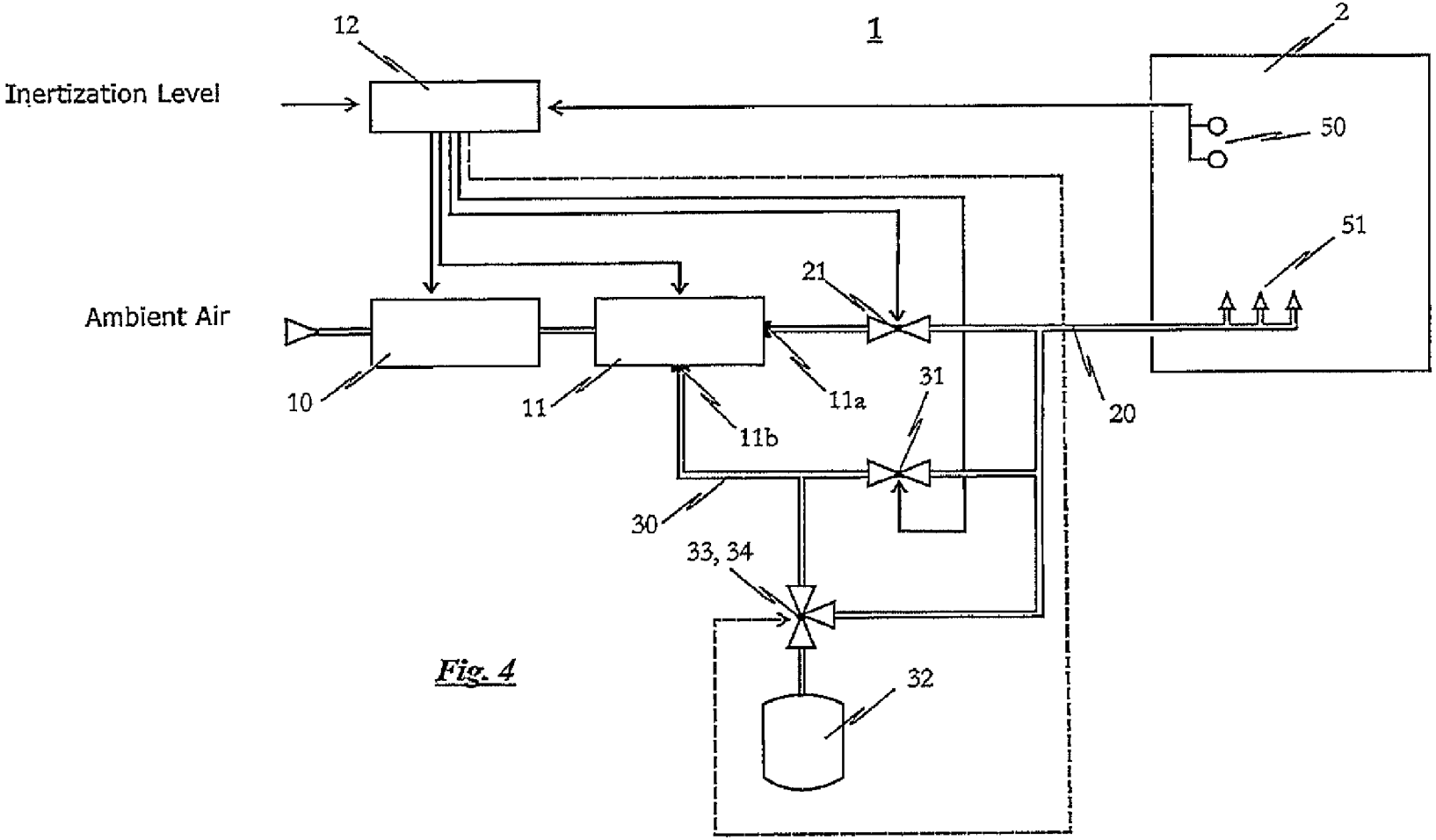
FIG. 4 illustrates a schematic view of a second embodiment of the inertization device of the invention according to a combination of the second and third aspects of the invention.

FIG. 4 shows a schematic view of a second embodiment of the inertization device 1 of the invention according to the third aspect of the invention represented in FIG. 3. The system shown in FIG. 4 differs from the embodiment according to FIG. 3 in that additionally a pressurized storage tank 32 for storing the oxygen-enriched air prepared by the nitrogen generator 11 is provided, whereby the control unit 12 is configured to control a controllable pressure-reducing valve 33, which is allocated to the pressurized oxygen storage tank 32 and connected to the second supply pipe system 30, in such a way, that the quantity of inert gas provided by the inert gas system 10, 11 and to be supplied to the protective room 2, and/or the oxygen concentration in the inert gas, can be set at the level that is appropriate to the establishment and/or maintenance of the specific inertization level.

Furthermore, a pressure-dependent valve device 34 is provided which is opened in a first, presettable pressure range, thereby permitting the pressurized oxygen storage tank 32 to be filled with the oxygen-enriched air provided by the nitrogen generator 11.

Figure 5:
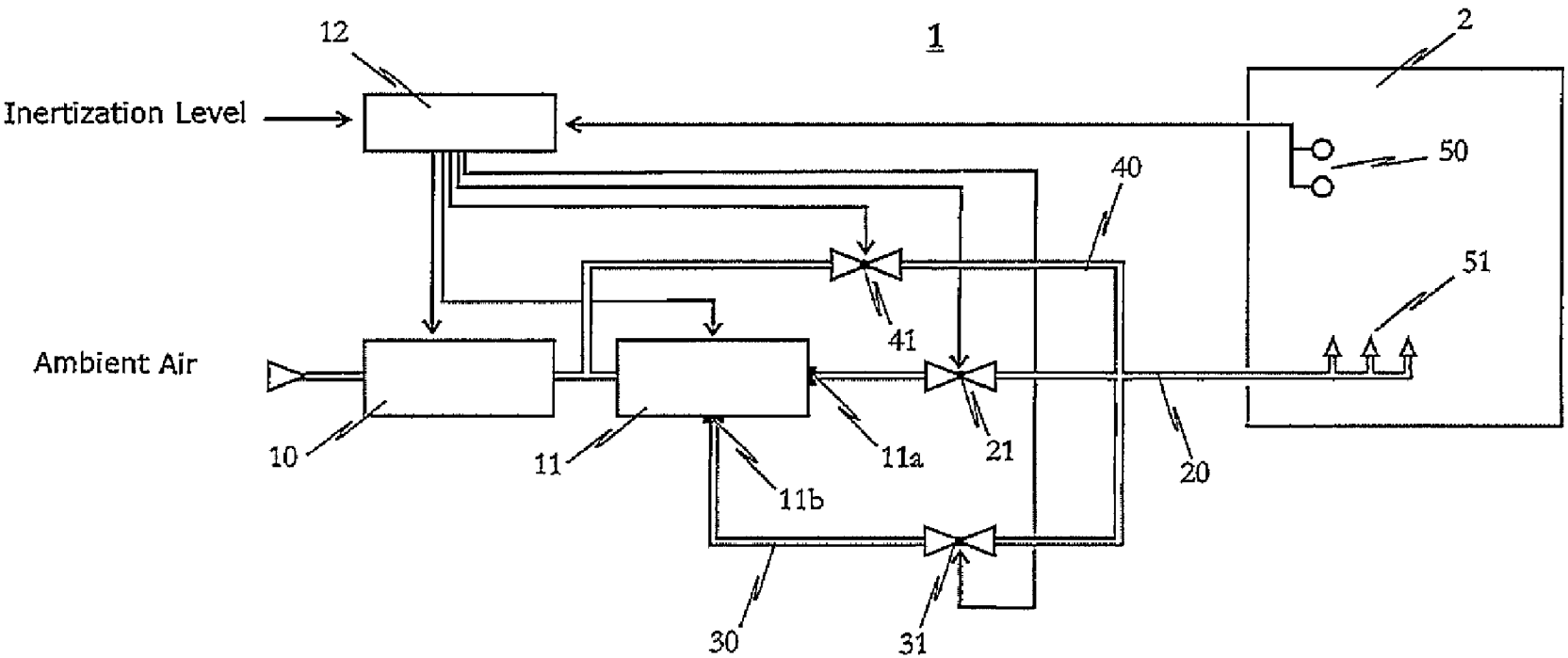
FIG. 5 illustrates a schematic view of an embodiment of the inertization device of the invention according to a combination of the first, second and third aspects of the invention.

FIG. 5 shows a schematic view of an embodiment of the inertization device 1 of the invention, according to a combination of the first, second and third aspects of the invention. Thus in this embodiment, a bypass pipe system 40 according to the first and second aspects of the invention, and a second supply pipe system 30 between the second outlet 11*b* of the nitrogen generator 11 and the first supply pipe system 20 are provided.

With respect to the functioning method and the advantages that can be achieved with the embodiment shown in FIG. 5, reference is made to what was described above.

Of course, it is also conceivable to also provide a pressurized storage tank for the oxygen-enriched air and/or a pressurized storage tank for the nitrogen-enriched air in the system according to FIG. 5, as is the case in the embodiments according to FIGS. 2 and 4.

Regarding the control of the nitrogen generator 11 via the control unit 12, it is also noted that the nitrogen generator 11 can have, for example, a cascade of individual membrane units, whereby the number of individual membrane units to be used to separate oxygen from the compressed air supplied by the compressed air source 10 and to provide the nitrogen-enriched air at the first outlet 11*a* of the nitrogen generator 11 can be selected via the control unit 12, whereby the degree of nitrogen enrichment in the nitrogen-enriched air provided by the nitrogen generator 11 can be controlled based upon the number of individual membrane units selected via the control unit 12.

In this regard it should be noted, that the configuration of the invention is not limited to the exemplary embodiments described in FIGS. 1 through 5, rather a multitude of variants are possible.

From the foregoing description, one ordinarily skilled in the art can easily ascertain the essential characteristics of this invention and, without departing from the spirit and scope thereof, can make various changes and modifications to the invention to adapt it to various usages and conditions.

LIST OF REFERENCE SYMBOLS

1 Inertization device
2 Protective room
10 Compressed air source; environmental air compressor
11 Inert gas generator
11*a* First outlet of the nitrogen generator for supplying nitrogen-enriched air
11*b* Second outlet of the nitrogen generator for plying oxygen-enriched air
12 Control unit
20 First supply pipe system
21 Controllable shut-off valve
22 Inert gas pressurized storage tank
23 Pressure-reducing valve
24 Pressure-dependent valve unit
30 Second supply pipe system
31 Controllable shut-off valve
32 Pressurized oxygen storage tank
33 Pressure-reducing valve
34 Pressure-dependent valve unit
40 Bypass pipe system
41 Controllable shut-off valve
50 Oxygen detection device
51 Discharge nozzles FIG. 1-5
Inertisierungsniveau Einstellsignal=Inertization Level Establishment Signal
Umgebungsluft=Ambient Air
$O_2$-angereicherte Luft=$O_2$-Enriched Air

What is claimed is:

1. An inertization device for establishing and maintaining an inertization level in a protective room, the inertization device comprising:
an inert gas system for providing inert gas;
a control unit for controlling the inert gas system to establish and maintain a desired inertization level in the protective room;
a first supply pipe system providing fluid communication between the inert gas system and the protective room to supply inert gas provided by the inert gas system to the protective room;
a compressed air source in fluid communication with the inert gas system; and
a bypass pipe system providing fluid communication between the compressed air source and the first supply pipe system, the bypass pipe system having a valve disposed therein, an opening and a closing of the valve controlled by the control unit to selectively permit and militate against a flow of air from the compressed air source to the protective room to at least one of establish and maintain the desired inertization level in the protective room.

2. The inertization device according to claim 1, wherein the compressed air source includes a pressurized storage tank for storing at least one of oxygen, oxygen-enriched air, fresh air, and compressed air, wherein the control unit is adapted to control a controllable pressure-reducing valve disposed between the pressurized storage tank and the first supply pipe system to control one of a quantity of the inert gas provided by the inert gas system and supplied to the protective room and a concentration of oxygen in the inert gas for at least one of establishing and maintaining the specific inertization level.

3. The inertization device according to claim 2, wherein the inert gas system includes a nitrogen generator in fluid communication with the compressed air source, and wherein the nitrogen generator separates oxygen from the compressed air from the compressed air source to provide a nitrogen-enriched air at a first outlet of the nitrogen generator, the nitrogen-enriched air supplied as the inert gas to the first supply pipe system, wherein the bypass pipe system bypasses the nitrogen generator to supply the compressed air provided by the compressed air source as needed to the protective room.

4. The inertization device according to claim 1, wherein the inert gas system includes a nitrogen generator in fluid communication with a compressed air source, and wherein the nitrogen generator separates oxygen from the compressed air from the compressed air source to provide a nitrogen-enriched air at a first outlet of the nitrogen generator, the nitrogen-enriched air supplied as the inert gas to the first supply pipe system, wherein the bypass pipe system bypasses the nitrogen generator to supply the compressed air provided by the compressed air source as needed to the protective room, and wherein the nitrogen generator is controlled by the control unit to at least one of establish and maintain the desired inertization level in the protective room, a concentration of oxygen in the inert gas supplied to the protective room controlled based upon a dwell time of the compressed air provided by the compressed air source in the nitrogen generator.

5. The inertization device according to claim 4, further comprising an air separation system contained in the nitrogen generator having a plurality of individual air separation units, wherein a number of the individual air separation units to be used to separate oxygen from the compressed air supplied by the compressed air source and provide the nitrogen-enriched air to the first outlet of the nitrogen generator is controlled by the control unit, and wherein a degree of nitrogen enrichment in the nitrogen-enriched air provided by the nitrogen generator is controlled based upon the number of individual air separation units selected by the control unit.

6. The inertization device according to claim 5, wherein the compressed air source is controlled by the control unit to control a flow rate of the compressed air through the air separation system contained in the nitrogen generator, thereby controlling the dwell time of the compressed air in the air separation system.

7. The inertization device according to claim 4, further comprising a second supply pipe system providing fluid communication between the inert gas system and the protective room, wherein the oxygen separated from the compressed air by the nitrogen generator is supplied as oxygen-enriched air to the second supply pipe system via a second outlet of the nitrogen generator to at least one of establish and maintain the desired inertization level in the protective room.

8. The inertization device according to claim 7, wherein the second supply pipe system is in fluid communication with the first supply pipe system and to facilitate fluid communication with the protective room.

9. The inertization device according to claim 8, further comprising a shut-off valve disposed in the second supply pipe system, an opening and a closing of the shut-off valve controlled by the control unit to selectively permit and militate against flow of oxygen-enriched air through the second supply pipe system.

10. The inertization device according to claim 9, wherein the inert gas system includes an oxygen storage tank for storing the oxygen-enriched air provided by the nitrogen generator, wherein the control unit controls a controllable pressure-reducing valve in fluid communication with the oxygen storage tank and the second supply pipe system to control a quantity of the inert gas provided by the inert gas system and supplied to the protective room.

11. The inertization device according to claim 10, further comprising a pressure-dependent valve unit which is opened in a first, presettable pressure range to permit the storage tank to be filled with the oxygen-enriched air provided by the nitrogen generator.

12. The inertization device according to claim 11, further comprising at least one shut-off valve disposed in the first supply pipe system and an opening and a closing thereof controlled by the control unit to selectively permit and militate against a flow of nitrogen-enriched air between the first outlet of the nitrogen generator and the protective room.

13. The inertization device according to claim 12, further comprising at least one oxygen detection device for detecting an oxygen ratio in air in the protective room, wherein the control unit is adapted to adjust a quantity of at least one of the inert gas supplied to the protective room and an oxygen concentration in the inert gas based upon the oxygen ratio measured in the air in the protective room.

14. The inertization device according to claim 13, wherein the oxygen detection device is an aspiration-type oxygen detection device.

15. The inertization device according to claim 14, wherein the inert gas system includes a nitrogen storage tank for storing nitrogen-enriched air provided by the nitrogen generator, wherein the control unit controls a controllable pressure-reducing valve in fluid communication with the nitrogen storage tank and the first supply pipe system to set a quantity of at least one of the inert gas supplied to the protective room and the oxygen concentration in the inert gas.

16. The inertization device according to claim 15, further comprising a pressure-dependent valve unit which is opened in a first, presettable pressure range to permit the nitrogen storage tank to be filled with the nitrogen-enriched air prepared by the nitrogen generator.

17. The inertization device according to claim 16, wherein the desired inertization level is one of a full inertization level, a base inertization level, and an accessibility level.

18. An inertization device for establishing and maintaining an inertization level in a protective room, the inertization device comprising:

an inert gas system for providing inert gas, the inert gas system further comprising a nitrogen generator;

a control unit for controlling the inert gas system to establish and maintain a desired inertization level in the protective room;

a first supply pipe system providing fluid communication between the inert gas system and the protective room to supply inert gas provided by the inert gas system to the protective room;

a compressed air source in fluid communication with the nitrogen generator of the inert gas system, wherein the nitrogen generator separates oxygen from the compressed air from the compressed air source to provide a nitrogen-enriched air at a first outlet of the nitrogen generator, the nitrogen-enriched air supplied as the inert gas to the first supply pipe system; and a bypass pipe system providing fluid communication between the compressed air source and the first supply pipe system, the bypass pipe system having a valve disposed therein, an opening and a closing of the valve controlled by the control unit to selectively permit and militate against a flow of air from the compressed air source to the protective room to at least one of establish and maintain the desired inertization level in the protective room, wherein the bypass pipe system bypasses the nitrogen generator to supply the compressed air provided by the compressed air source as needed to the protective room.

19. An inertization device for establishing and maintaining an inertization level that can be preset inside a protective room to be monitored, the inertization device comprising:

a controllable inert gas system for providing inert gas;

a first supply pipe system connected to the inert gas system and the protective room to provide the inert gas prepared by the inert gas system to the protective room;

a control unit configured to control the inert gas system such that a specific, presettable inertization level is established and maintained inside the protective room; and a bypass pipe system connected to the control unit via a shut-off valve, which bypass system is connected on one side to a compressed air source and on an other side to the first supply pipe system to feed the compressed air provided by the compressed air source directly to the protective room as fresh air, and at least one of establish and maintain the specific, presettable inertization level inside the protective room.

* * * * *